US007421968B1

(12) United States Patent
Hu

(10) Patent No.: US 7,421,968 B1
(45) Date of Patent: Sep. 9, 2008

(54) BOAT THAT IS PROVIDED WITH FLOATING TUBES IN A MULTI-LAYER DESIGN

(76) Inventor: Yen-Lu Hu, 9F, No. 368, Zhongshan W. Rd., Fengshan City, Kadslung County 830 (TW)

( * ) Notice: Subject to any disclaimer, the term of this patent is extended or adjusted under 35 U.S.C. 154(b) by 0 days.

(21) Appl. No.: 11/708,141

(22) Filed: Feb. 20, 2007

(51) Int. Cl.
*B63B 7/00* (2006.01)

(52) U.S. Cl. ..... 114/345; 114/219; 441/40

(58) Field of Classification Search ..... 114/219, 114/343, 345, 357, 364; 441/40, 41, 42
See application file for complete search history.

(56) References Cited

U.S. PATENT DOCUMENTS 4,924,796 A * 5/1990 Duffy ..... 114/219
4,928,619 A * 5/1990 Cochran ..... 114/345
6,371,040 B1 * 4/2002 Hemphill et al. ..... 114/219
2004/0069203 A1 * 4/2004 Fleming ..... 114/345

* cited by examiner

*Primary Examiner*—Lars A Olson
(74) *Attorney, Agent, or Firm*—Troxell Law Office, PLLC

(57) ABSTRACT

A boat that is provided with floating tubes in a multi-layer design is composed a plurality of floating tube devices which are installed respectively at a left and a right side of a hull, and is provided with an air bag, a buffer, and a surface layer unit. The buffer is provided with a holding space and an assembling slot hole; whereas, the surface layer unit is provided with a sealing element which is used to seal the assembling slot hole, such that the floating tube devices are configured as a multi-layer design to facilitate balance, anti-collision, and increase of chance of survival.

4 Claims, 9 Drawing Sheets

BOAT THAT IS PROVIDED WITH FLOATING TUBES IN A MULTI-LAYER DESIGN

BACKGROUND OF THE INVENTION a) Field of the Invention

The present invention relates to a boat that is provided with floating tubes in a multi-layer design, and more particularly to a boat that is provided with floating tubes for facilitating balance, anti-collision, and survival, and is provided with a multi-layer design at interiors of the floating tubes.

b) Description of the Prior Art

As a boat is generally traveling very fast on water surface, a hull will be usually tilted upon changing direction, which allows two sides of the hull to be easily collided with the water. Therefore, some boats are designed to be equipped with floating tubes for facilitating balance.

Referring to FIG. 1, a conventional boat 1 is provided with a hull 11 and a floating tube 12 which surrounds and is fixed at a periphery of a top part of the hull 11. The hull 11 will be installed with a motor, chairs, and driving equipment, wherein the floating tube 12, which is made by Hypalon, is in a hollow shape and its interior is formed with a charging space 13 that can be filled with air, such that the floating tube 12 can be flexible and can provide buoyancy force.

In terms of the boat 1, the floating tube 12 is primarily to provide effects of balance and anti-collision. However, once the floating tube 12 made by Hypalon is subjected to impact of huge external force, it will be usually ruptured, allowing the air in the charging space 13 to quickly leak out. Then, the floating tube 12 will easily lose its original function, and thus needs to be repaired.

In order to increase durability of the floating tube, there are vendors who manufacture the floating tube 12 totally with EVA (Ethylene Vinyl Acetate) material. This design method has overcome the aforementioned flaw that the floating tube 12 is easily ruptured; however, weight of the entire boat 1 will be increased too. Therefore, it is not absolutely perfect.

SUMMARY OF THE INVENTION

The primary object of present invention is to provide a boat that is provided with floating tubes in a multi-layer design, which can prevent air from quickly leaking out.

Accordingly, the boat that is provided with floating tubes in a multi-layer design, in accordance with the present invention, is suitable for carrying a few persons to travel on designated water surface, and includes a hull and a plurality of floating tube devices which are orderly connected and installed at a left and a right side of the hull. The hull can float on the aforementioned water surface by contacting the water, and can be used to carry the aforementioned persons. The floating tube devices are at least installed at the left and right sides of the hull, and each floating tube device is provided with an inflatable air bag, a buffer which encloses at an outer periphery of the air bag, and a surface layer unit which encloses at an outer periphery of the buffer. The buffer provides a holding space for emplacing the air bag, and an assembling slot hole which is radially connected with the holding space; whereas, the surface layer unit is provided with a sealing element which corresponds to the assembling slot hole and is used to seal that assembling slot hole again. As the floating tube device of the boat is a multi-layer design, when the floating tube device is damaged by external force, the internal air bag will not be damaged directly, thereby achieving a purpose of preventing the air from quickly leaking out.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
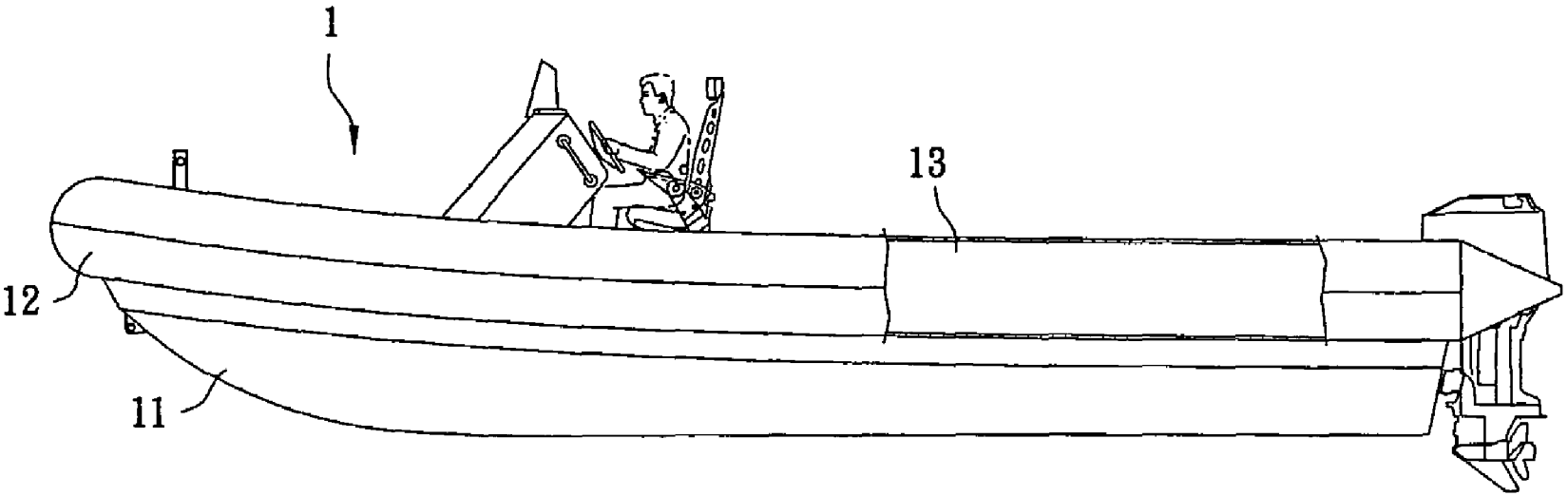
FIG.1 Prior Art
FIG. 1 shows a side view of a conventional boat.
Figure 2:
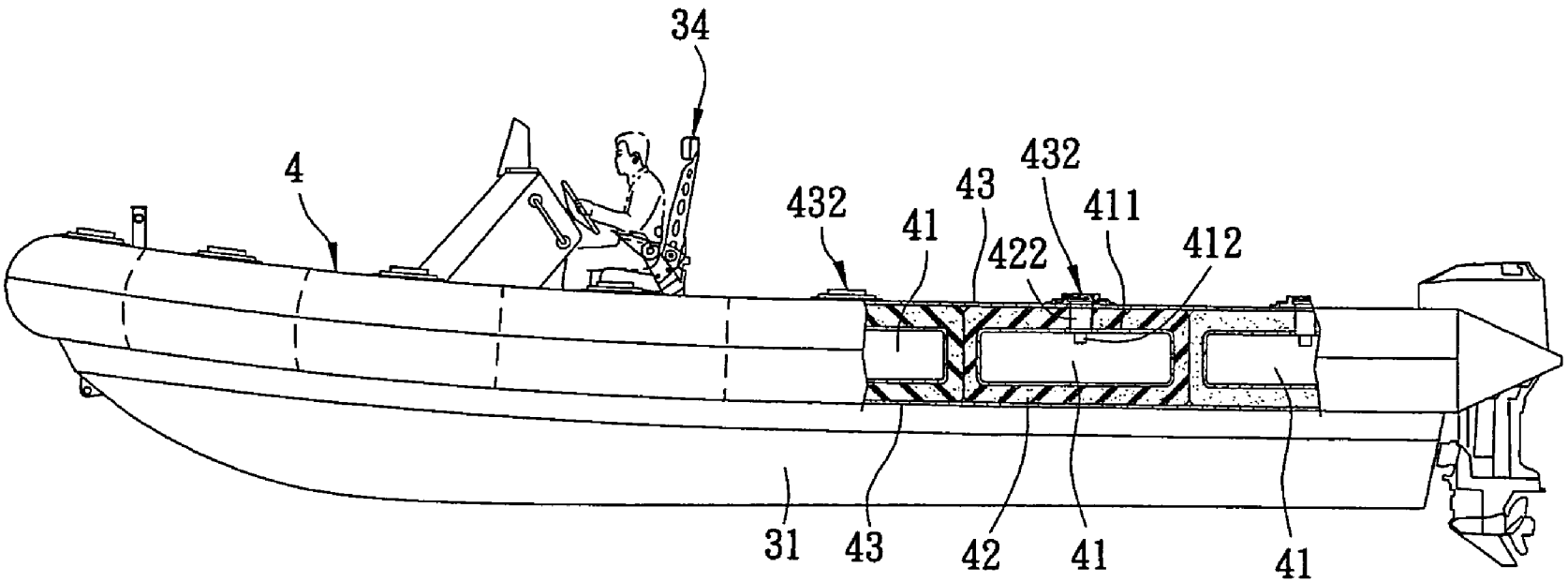
FIG. 2 shows a local cutaway view at a side of a first preferred embodiment of the present invention.
Figure 8:
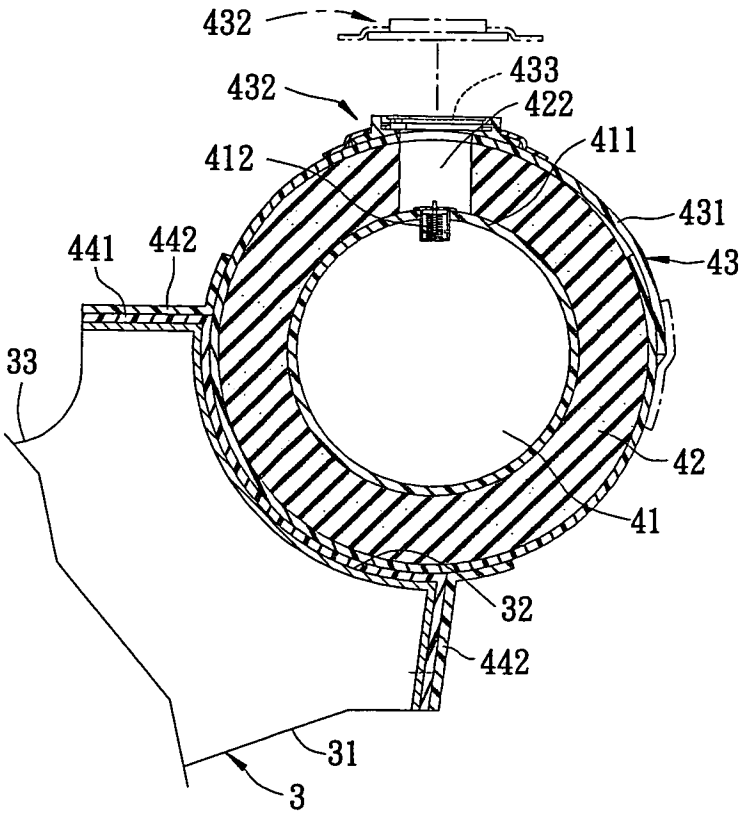
FIG. 8 shows a cutaway view of a first preferred embodiment of a floating tube device, after being assembled.

Referring to FIG. 2 and FIG. 8, a preferred embodiment of a boat that is provided with floating tubes in a multi-layer design 2 of the present invention is suitable for carrying a few persons to travel on designated water surface. The boat 2 comprises a hull 3 and a plurality of floating tube devices 4.

The hull 3 floats on the aforementioned water surface by contacting the water and is used to carry the aforementioned persons. This hull 3 is provided with a pointed arc shape bottom surface 31 for contacting the water surface, an installation surface 32 which surrounds a top rim of the bottom surface 31, and a carrying surface 33 which extends from the installation surface 32 to be located roughly above the bottom surface 31. In order to be able to float on the water surface, the hull 3 is designed as a hollow shape for being provided with buoyancy force, and a plurality of equipment on the boat 2 is installed on the carrying surface 33; whereas other apparatus, such as an oil tank, is installed in an interior of the hull 3. The carrying surface 33 of the hull 3 is also provided with a plurality of chairs 34 (not completely shown in the drawings) to be seated by drivers. However, all the aforementioned structures belong to the prior art, and are not the characteristics of the present invention.

In this embodiment, each floating tube device 4 is installed one by one at a left and a right side of the hull 3, and is provided with an air bag 41 which can be filled with air, a buffer 42 which encloses at an outer periphery of the air bag 41, and a surface layer unit 43 which encloses at an outer periphery of the buffer 42.

Figure 3:
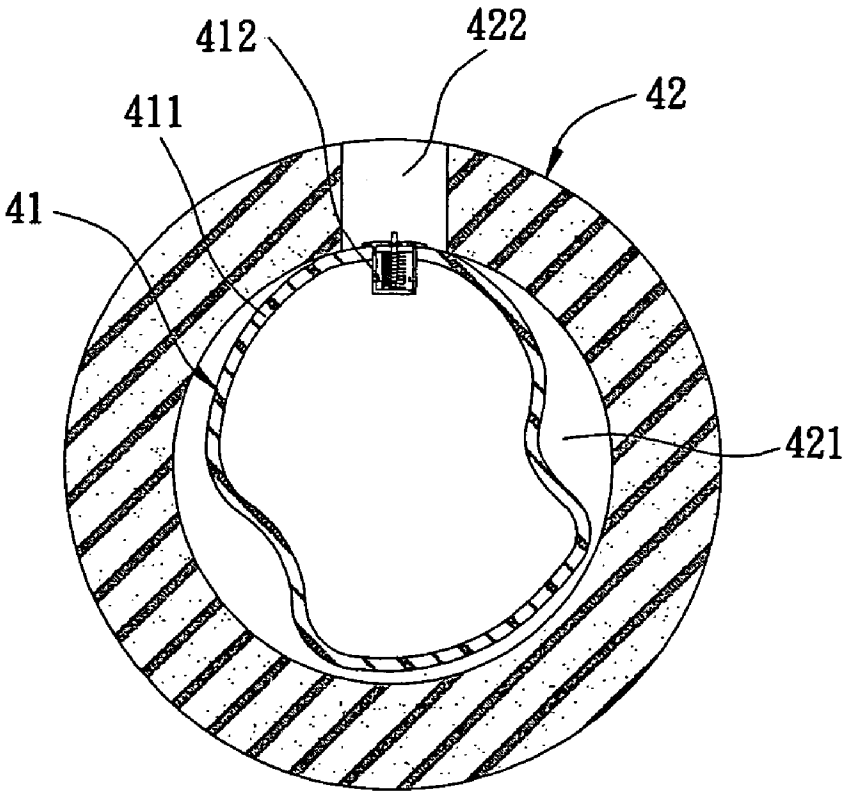
FIG. 3 shows a schematic view of a first stage of assembling a floating tube device of a first preferred embodiment.
Figure 4:
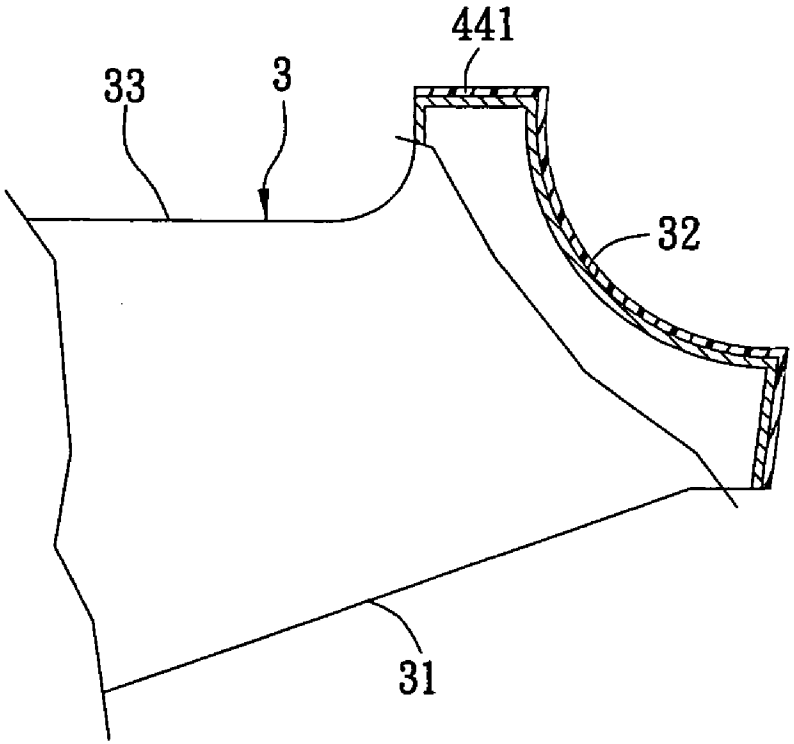
FIG. 4 shows a schematic view of a second stage of assembling, similar to FIG. 3.
Figure 5:
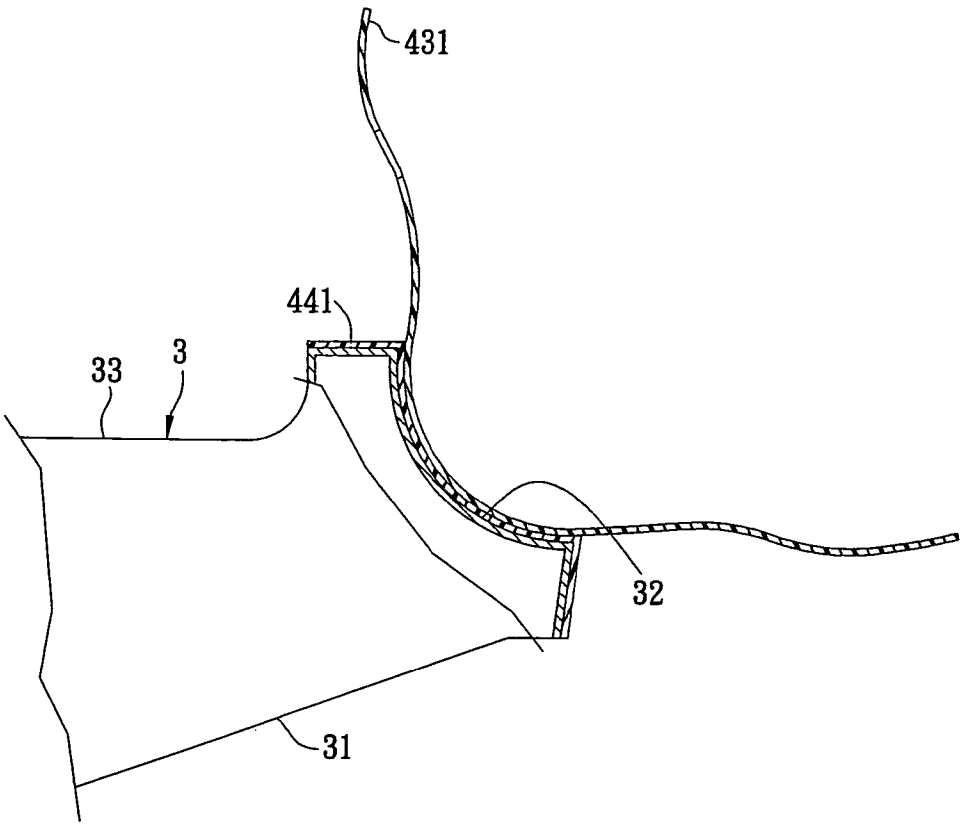
FIG. 5 shows a schematic view of a third stage of assembling, similar to FIG. 4.
Figure 6:
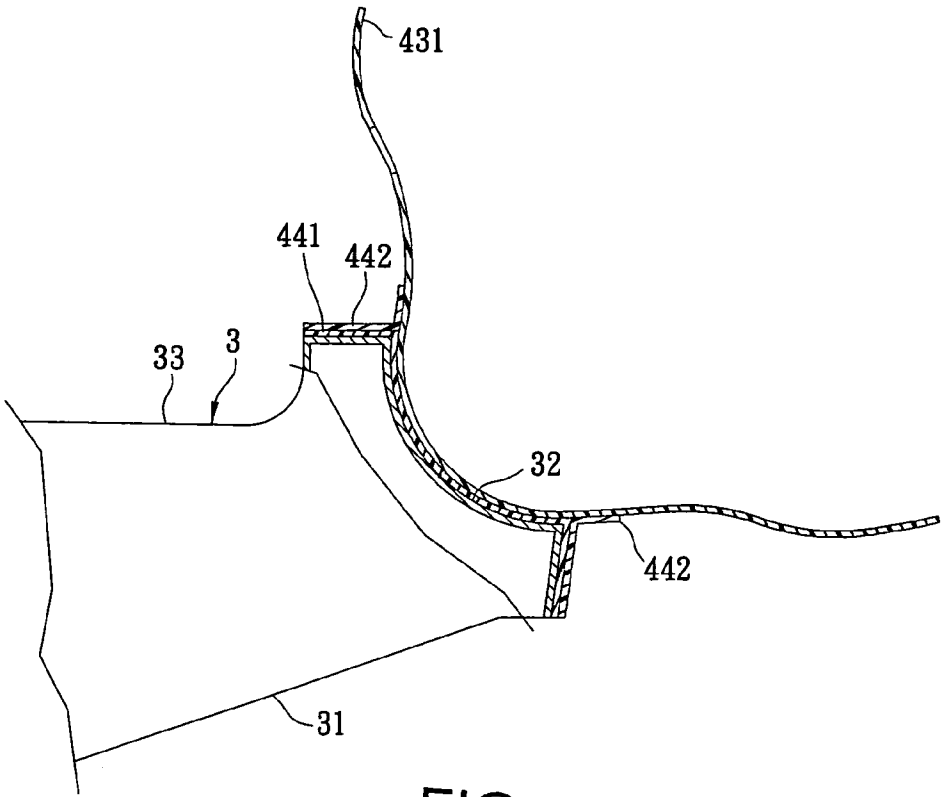
FIG. 6 shows a schematic view of a fourth stage of assembling, similar to FIG. 5.
Figure 7:
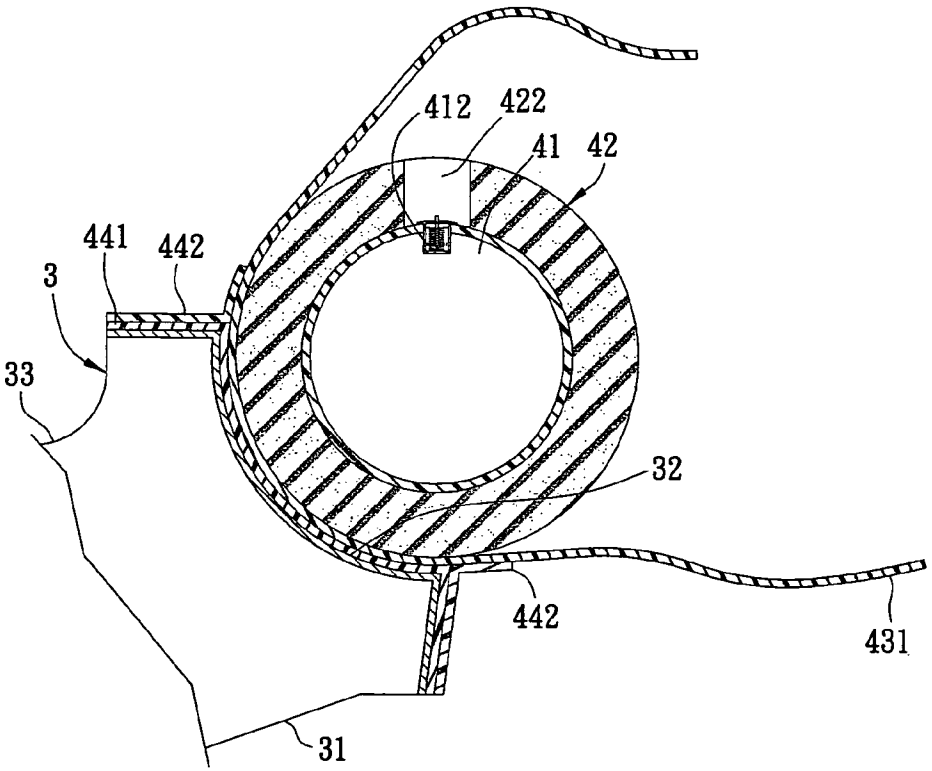
FIG. 7 shows a schematic view of a fifth stage of assembling, similar to FIG. 6.

Referring to FIG. 3 and FIG. 8, the air bag 41 is provided with a flexible bag body 411, and a nozzle 412 which is connected with the bag body 411 and can adjust air that enters into the bag body 411. The nozzle 412 is provided with a stopping design which prohibits the air from being escaped reversely after being filled in, wherein the flexible bag body 411 is made by Hypalon, but can be also made by PVC (Polyvinyl Chloride) material. The buffer 42 is made by EVA material into a hollow barrel, wherein its interior is formed with a holding space 421 for emplacing the bag body 411 of the air bag 41, and a slot hole 422 which is radially connected with that holding space 421, such that a charging apparatus can pass through the buffer 42 to pump the air into the bag body 411 through the nozzle 412. In the embodiment, a front and a rear end of the buffer 42 are a closed design. In design, volume of the bag body 411 after being charged is a little larger than volume of the holding space 421, wherein the buffer 42 is not limited to be made by the EVA material, but can be also made by material which is light-weight, is provided with buoyancy force, and is collision-proof.

Referring to FIG. 8, the surface layer unit 43 is provided with a surface cloth 431, a positioning seat 432 which is fixed on this surface cloth 431, and a sealing element 433 which is fixed on the positioning seat 432, corresponds to a location of the assembling slot hole 422, and can be used to seal the assembling slot hole 422 again. The positioning seat 432 is affixed on a surface of the surface cloth 431, and a periphery of the positioning seat 432 is covered by a patch to assist with the assembling.

The sealing element 433 can be dismantled from and assembled with the positioning seat 432. However, a detailed structure of the sealing element 433 belongs to the prior art, and thus is not the characteristic of the present invention. Therefore, further description is not necessary. In addition, surfaces of the positioning seat 432 and the sealing element 433 are a rough surface design, and can provide for a stepping use when the persons get on and off the boat, so as to provide a slid-proof effect. On the other hand, the design of sealing element 433 is not limited to the aforementioned technology, but practically, an adhesive cloth can be also used to achieve a purpose of sealing.

Referring to FIG. 3, an assembly method of the air bag 41 and the buffer 42 is described next. First of all, the flexible bag body 411, which has not been filled with the air yet, is stuffed into the holding space 421 through the slot hole 422, and the air starts to be filled into the bag body 411 from the nozzle 412 to gradually inflate the bag body 411, such that an outer wall of the bag body 411 can be more tightly attached with an inner wall of the buffer 42.

After accomplishing the aforementioned assembly operations, the buffer 42, the interior of which is provided with the air bag 41, is assembled with the surface cloth 431. Referring to FIGS. 4 to 8, the assembly method for installing the floating tube device 4 on the boat includes a first stage that the installation surface 32 of the hull 3 is attached with a bottom cloth 441; a second stage that the unfolded surface cloth 431 is attached on a surface of the bottom cloth 441; a third stage that a top and a bottom rim at the assembly place of the bottom cloth 441 and the surface cloth 431 are attached with auxiliary patches 442; a fourth stage that the aforementioned buffer 42 is emplaced at an enclosable position of the surface cloth 431 and the surface cloth 431 is tightly wrapped at an exterior side of the buffer 42; and a final stage that two side rims of the surface cloth 431 are assembled together to accomplish the entire assembly process. In the practical assembly process, affixing places at two side rims of the aforementioned surface cloth 431 are further attached with a friction-proof pad for preventing from friction.

Practically, the surface cloth 431 will be reserved with an opening for assembling the positioning seat 432 and corresponding to the slot hole 422 of the buffer 42. After accomplishing the aforementioned assembly process, the positioning seat 432 will be installed on this opening.

Referring to FIG. 2 and FIG. 8, according to the aforementioned design, for the boat 2 of present invention, the buffer 42 is installed at the exterior side of the air bag 41 to protect the air bag 41, so as to prevent the floating tube device 4 from being collided or being pierced by alien objects to lose its original function, such that even if the air bag 41 is ruptured, the air inside the bag body 411 will not be leaked out quickly. In addition, the buffer 42 still provides a part of buoyancy force, which enables the floating tube device 4 to be still provided with its fundamental function; and its design method will not excessively increase weight of the floating tube device 4.

Furthermore, the design of positioning seat 432 and sealing element 433 can even provide for the stepping when the persons get on and off the boat; whereas, the sealing element 433 can protect the nozzle 412 to prevent the air from leaking out upon being collided by external force.

Figure 9:
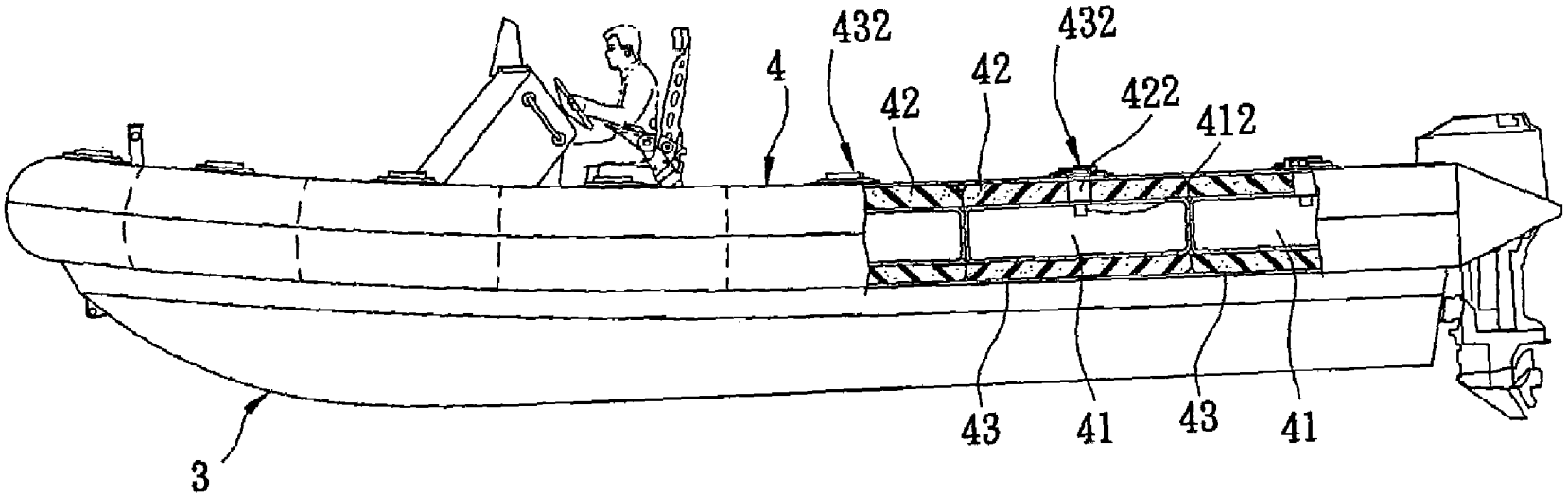
FIG. 9 shows a local cutaway view at a side of a second preferred embodiment of the present invention.

Referring to FIG. 9, a second preferred embodiment of the present invention is about the same as the first preferred embodiment, with difference being that in this embodiment, the front and rear ends of the buffer 42 are not the closed design, which is more suitable to boats of smaller size.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A boat that is provided with floating tubes in a multi-layer design, which is suitable for carrying a few persons to travel on designated water surface, comprising a hull, which floats on the water surface by contacting the water and is used to carry the aforementioned persons; and a plurality of floating tube devices, which are connected orderly and are installed at a left and a right side of the hull, with each floating tube device being provided with an air bag which is filled with air, a buffer which encloses at an outer periphery of the air bag, and a surface layer unit which encloses at an outer periphery of the buffer; the buffer providing a holding space for emplacing the air bag, and an assembling slot hole which is radially connected with the holding space; the surface layer unit being provided with a sealing element which corresponds to the assembling slot hole and is used to seal that assembling slot hole again, wherein the air bag is provided with a flexible bag body forming a circular cross section when inflated and a nozzle which is connected with the bag body and adjusts air that enters into the bag body, the nozzle being located at an interior end of the assembling slot hole.

2. The boat that is provided with floating tubes in a multi-layer design, according to claim 1, wherein the flexible bag body is made of chlorosulfonated polyethylene.

3. The boat that is provided with floating tubes in a multi-layer design, according to claim 1, wherein the flexible bag body is made by PVC (Polyvinyl Chloride) material.

4. The boat that is provided with floating tubes in a multi-layer design, according to claim 1, wherein the buffer is made by EVA (Ethylene Vinyl Acetate) material.

* * * * *